US008523620B2

(12) United States Patent
Hopkins

(10) Patent No.: US 8,523,620 B2
(45) Date of Patent: Sep. 3, 2013

(54) FLOATING TRANSOM

(76) Inventor: Dwayne Ray Hopkins, Azle, TX (US)

( * ) Notice: Subject to any disclaimer, the term of this patent is extended or adjusted under 35 U.S.C. 154(b) by 0 days.

(21) Appl. No.: 13/135,743

(22) Filed: Sep. 29, 2011

(65) Prior Publication Data

US 2013/0084761 A1 Apr. 4, 2013

(51) Int. Cl.
*B63H 5/20* (2006.01)

(52) U.S. Cl.
USPC ..... 440/53; 248/642; 440/61 R; 440/61 T

(58) Field of Classification Search
USPC ..... 248/640–642; 440/53, 63, 61 R, 440/61 T, 61 E, 61 F, 61 H
See application file for complete search history.

(56) References Cited

U.S. PATENT DOCUMENTS

| | | | | |
|---|---|---|---|---|
| 2,713,843 | A * | 7/1955 | Staley | 440/63 |
| 2,886,462 | A * | 5/1959 | Jagiel | 248/617 |
| 3,032,304 | A * | 5/1962 | Machlan | 248/641 |
| 3,075,490 | A * | 1/1963 | Lang | 440/53 |
| 4,890,811 | A * | 1/1990 | Ehni | 248/642 |

* cited by examiner

*Primary Examiner* — Edwin Swinehart

(57) ABSTRACT

This invention is The Floating Transom. The floating transom comes with manual control, and two 12 volt hydraulic systems, and clamps on the back of a boat, extending a new transom eighteen inches behind the boats transom. When traveling in ten inches of water the floating transom allows the boat motor to be picked up, lifting up the boat motor until the lower unit is flush with the bottom of the boat. The adjustable trim on the floating transom allows the back plate, which the boat motor clamps on. To adjust the angle of the boat motor, making the boat move flat on the top of the water. The lower unit of the boat motor rides in the wake the boat forms, making the water pump work, cooling the boat motor. Allowing you to move up or down shallow water rivers.

3 Claims, 8 Drawing Sheets

FLOATING TRANSOM

BRIEF DESCRIPTION OF THE DRAWING

FIG. 1.B. Shows the position of the motor when the floating transom is all the way up.

FIG. 8.A.B. Shows the lifting arm lowering spool all the way out and all the way in.

The floating transom clamps on the back of the boat with two floating transom mounting bracket mounting clamps. FIG. 6G. extending a new transom 18 inches from the boat transom, shown in FIG. 1.

Figure 2:
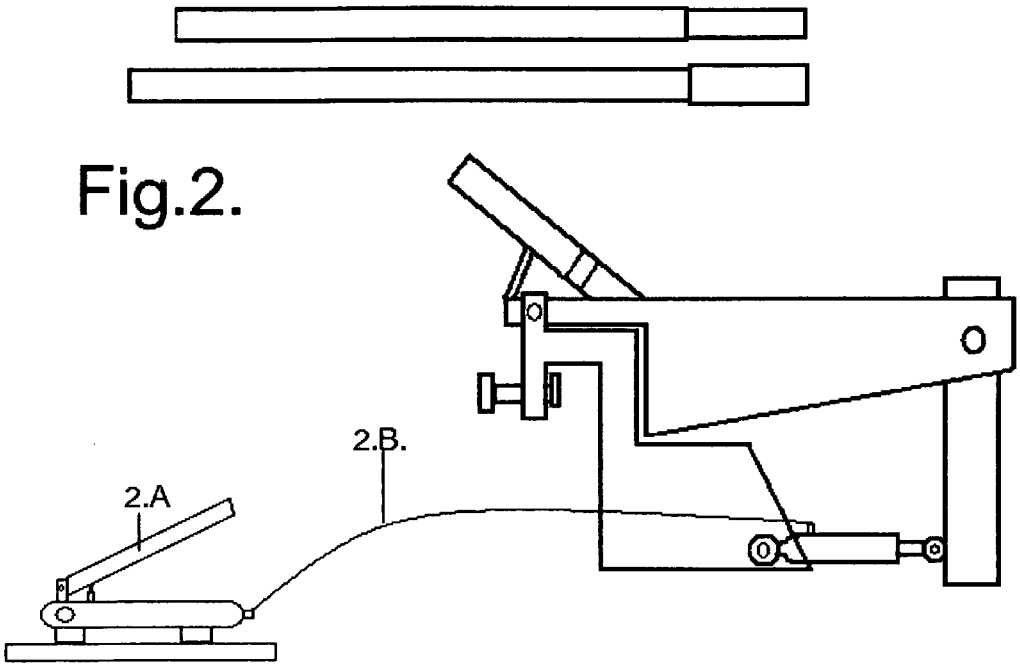
FIG. 2.A.B. Shows the manually floating transom.
Figure 3:
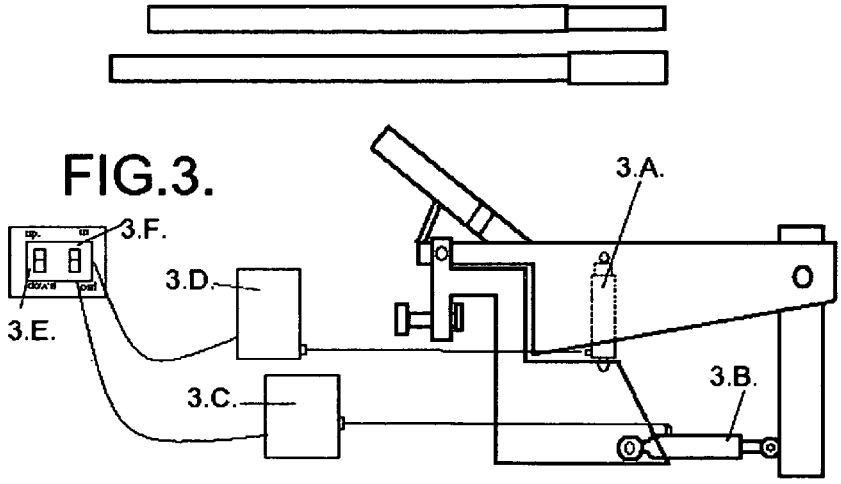
FIG. 3 A.B.C.D.E.F. Shows the two hydraulic systems, for the hydraulic floating transom FIG. 4. Shows the mounting bracket, that clamps on the back of the boat.

The hydraulic hand pump FIG. 2.A. and the hydraulic hose FIG. 2.B., shown in FIG. 2. comes as a back up system for the floating transom hydraulic unit FIG. 3.C., are the lifting bracket hydraulic unit FIG. 3.D.

Figure 6:
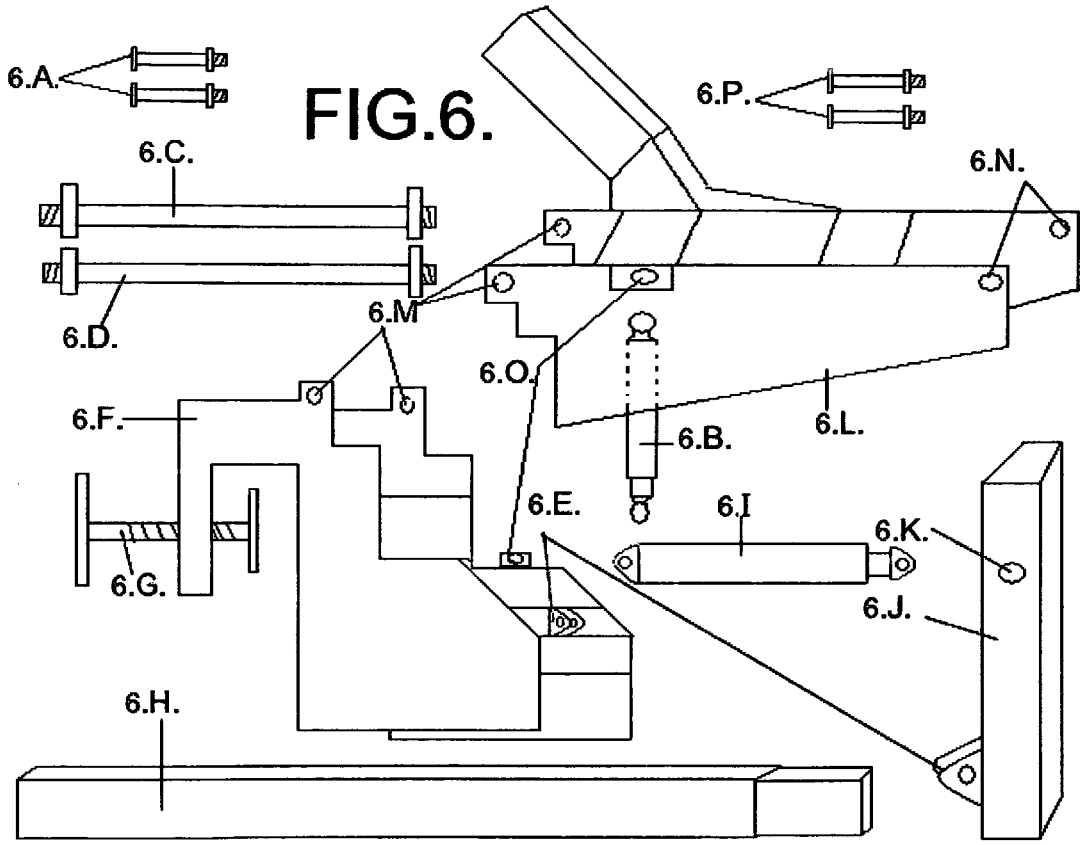
FIG. 6.A.B.C.D.E.F.G.H.I.J.K.L.M.N.O.P. Shows the parts in the manually floating transom bracket.

The lifting bracket ram FIG. 3.A., shown in FIG. 3. lifts up the lifting bracket FIG. 6.L.

The floating transom back plate hydraulic ram FIG. 3.B., shown in FIG. 3. allows the floating transom back plate FIG. 6.J. to move in or out.

The floating transom hydraulic unit FIG. 3.C., shown in FIG. 3 moves the floating transom back plate hydraulic ram FIG. 3.B. in or out with the floating transom back plate hydraulic ram in and out switch FIG. 3.E.

The lifting bracket hydraulic unit FIG. 3.D., shown in FIG. 3. moves the lifting bracket hydraulic ram FIG. 3.A. up and down with the lifting bracket hydraulic ram up and down switch FIG. 3.F.

The floating transom back plate hydraulic ram in and out switch FIG. 3.E., shown in FIG. 3. moves the floating transom back plate FIG. 6.J. in and out.

Figure 1:
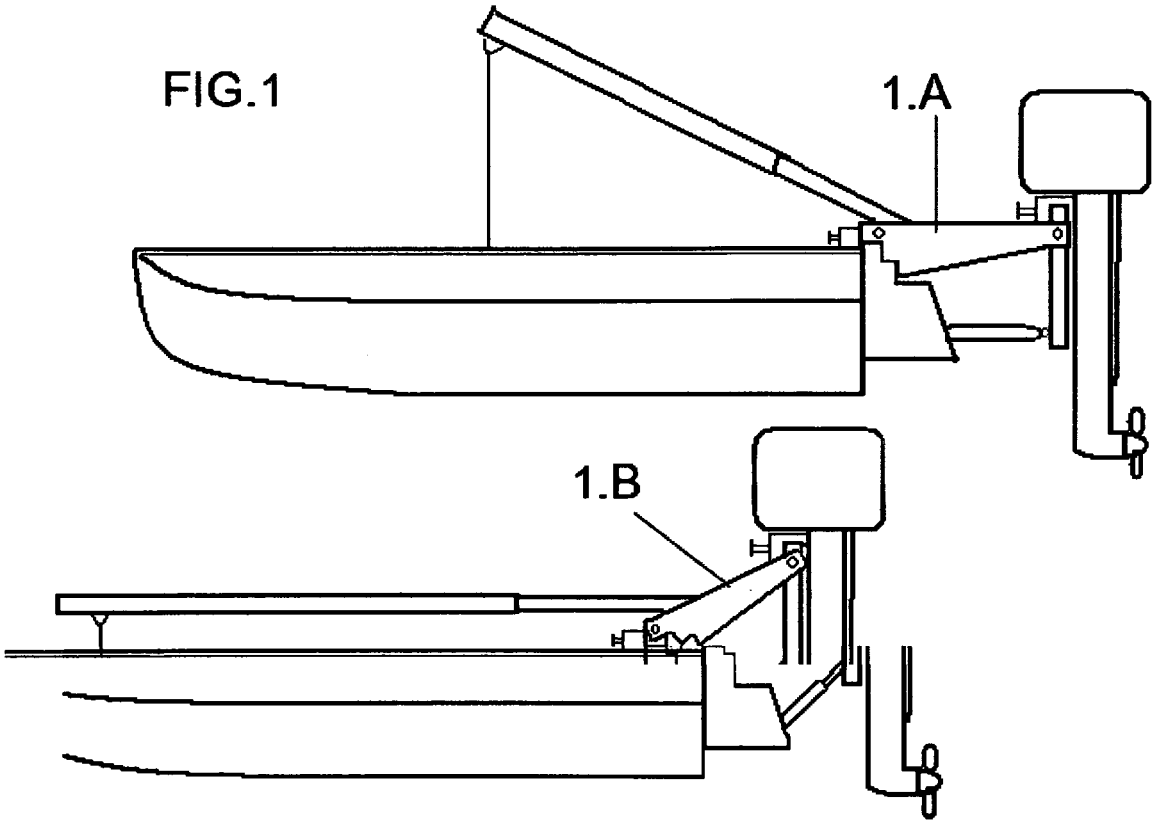
FIG. 1.A. Shows the position of the motor when the floating transom is all the way down.

The lifting bracket hydraulic ram up and down switch FIG. 3.F., shown in FIG. 3. lifts the lifting bracket FIG. 6.L. up and down, shown in FIG. 1.A. and FIG. 1.B.

Figure 4:
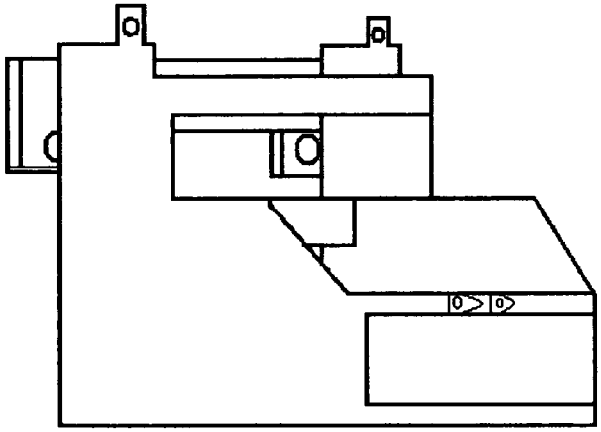

The floating transom mounting bracket FIG. 6.E., shown in FIG. 4. clamps on the back of the boat, shown in FIG. 1.

Figure 5:
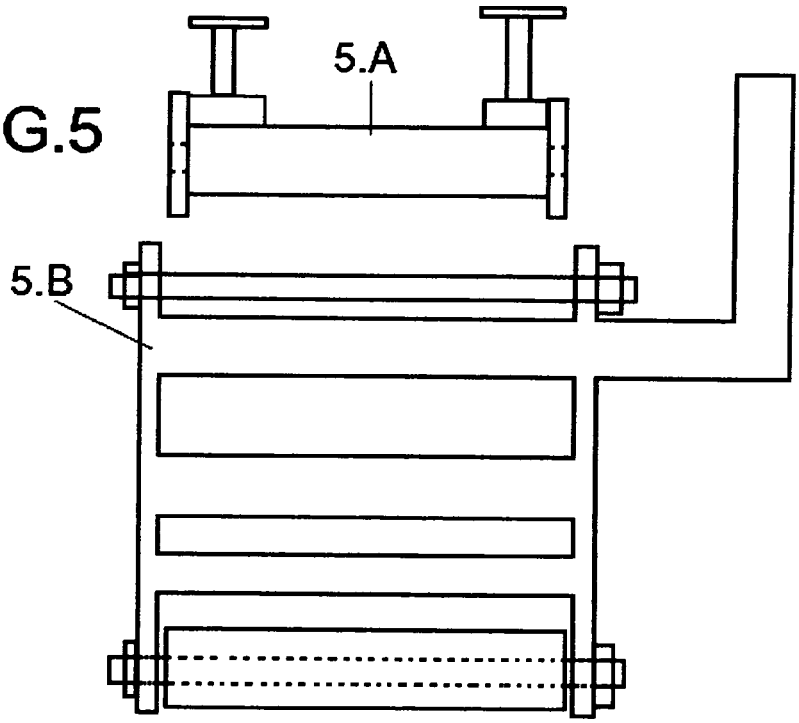
FIG. 5.A.B. Shows the top view of the lifting bracket, and the mounting bracket.

Top view of mounting bracket FIG. 5.A., shown in FIG. 5.

Top view of lifting bracket FIG. 5.B., shown in FIG. 5.

The lifting bracket hydraulic ram mounting bolts FIG. 6.A., shown in FIG. 6.

The lifting bracket hydraulic ram FIG. 6.B., shown in FIG. 6. lifts and lowers the lifting bracket FIG. 6.L.

The lifting bracket pivot rod FIG. 6.C., shown in FIG. 6. allows the lifting bracket FIG. 6.L. to pivot on the floating transom mounting bracket FIG. 6.F., shown in FIG. 1.

The floating transom back plate pivot rod FIG. 6.D, shown in FIG. 6. allows the floating transom back plate 6.J. to pivot on the lifting bracket FIG. 6.L.

The floating transom hydraulic ram mounting bolts bracket FIG. 6.E., shown in FIG. 6. makes the connection of the floating transom back plate ram FIG. 3.B. to the floating transom mounting bracket FIG. 6.F. and to the floating transom back plate FIG. 6.J.

The floating transom mounting bracket FIG. 6.E., shown in FIG. 6. mounts on the back of the boat, shown in FIG. 1.

The floating transom mounting bracket mounting clamps FIG. 6.G., shown in FIG. 6. clamps the floating transom mounting bracket FIG. 6.F. on the back of the boat, shown in FIG. 1.

The lifting arm FIG. 6.H., shown in FIG. 6. connects on to the lifting bracket FIG. 6.L. allowing the lifting bracket FIG. 6.L. to move up and down manually.

The floating transom hydraulic ram FIG. 6.I., shown in FIG. 6., connects the floating transom back plate FIG. 6.J. to the floating transom mounting bracket FIG. 6.F. allowing the floating transom back plat FIG. 6.J. to move in and out adjusting the angle of the boat motor.

The floating transom back plate FIG. 6.J., shown in FIG. 6., pivots to allow the angle of the boat motor to be adjusted, making the boat move flat on the top of the water The floating transom back plate pivot rod chamber FIG. 6.K., shown in FIG. 6., allows the floating transom back plate FIG. 6.J to pivot on the lifting bracket FIG. 6.L.

The lifting bracket FIG. 6.L., shown in FIG. 6. pivots on the floating transom mounting bracket FIG. 6.F. and the floating transom back plate FIG. 6.J., allowing the boat motor angle to be adjusted.

The lifting bracket pivot rod holes FIG. 6.M, shown in FIG. 6., connect the lifting bracket FIG. 6.L. to the floating transom mounting bracket FIG. 6.F., with the lifting bracket pivot rod FIG. 6.C.

The floating transom back plate pivot rod holes FIG. 6.N., shown in FIG. 6. connect the lifting bracket FIG. 6.L. and the floating transom back plate FIG. 6.J with the floating transom back plate pivot rod FIG. 6.D.

The lifting bracket hydraulic ram mounting bracket FIG. 6.O. shown in FIG. 6., mounts the lifting bracket FIG. 6.L., to the floating transom mounting bracket FIG. 6.F. with the floating transom hydraulic ram FIG. 6.I. and the floating transom ram mounting bolts FIG. 6.P.

Figure 7:
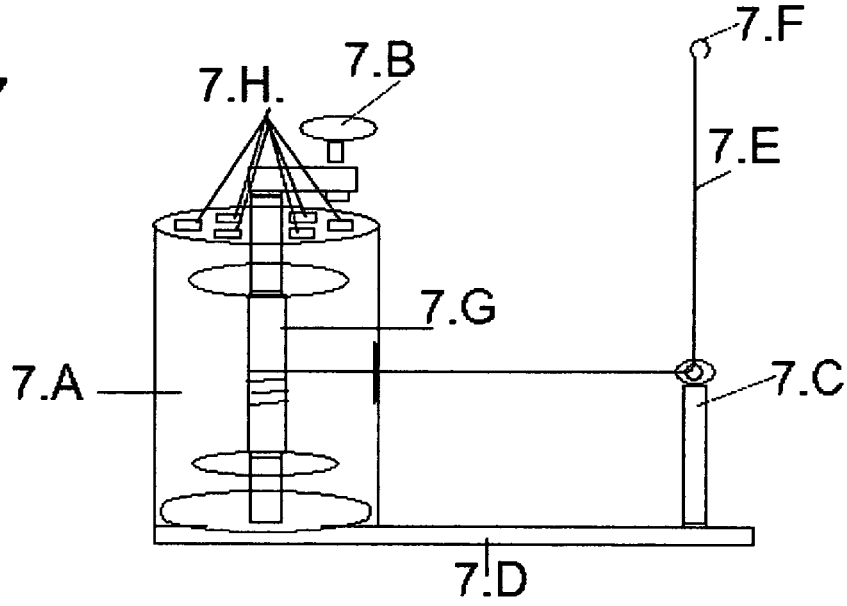
FIG. 7.A.B.C.D.E.F.G.H. Shows the lifting arm lowering spool, for the manually floating transom.

The floating transom hydraulic ram mounting bolts FIG. 6.P., shown in FIG. 6., connects the floating transom hydraulic ram FIG. 6.I., to the floating transom mounting bracket FIG. 6 E., The lowering spool cover FIG. 7.A, shown in FIG. 7., allows the locking pin FIG. 7.B., to be locked in six different positions, allowing the lifting arm FIG. 6.H., to be adjusted up are down.

The locking pin FIG. 7.B., shown in FIG. 7., allows the wire cable FIG. 7.E., to be pulled in, moving the lifting arm FIG. 6H. down.

The wire cable line up bracket FIG. 7.C., shown in FIG. 7., lines up the wire cable FIG. 7.E., going to the lowering spool FIG. 7.G.

(The lifting arm lowering spool bottom plate FIG. 7.D., shown in FIG. 7., allows the lowering FIG. 7.G., and the wire cable line up bracket FIG. 7.C. to be mounted in the boat, in line with the lifting arm FIG. 6.H.

The wire cable FIG. 7.E., shown in FIG. 7., connects the lowering spool FIG. 7.G. to the lifting arm FIG. 6H.

The wire cable hook FIG. 7.F., shown in FIG. 7., connects to the lifting arm FIG. 6.H.

The lowering spool FIG. 7.G., shown in FIG. 7 rotates around, pulling in the wire cable FIG. 7.E., lowering the lifting arm FIG. 6.H.

The locking pin holes FIG. 7.H., shown in FIG. 7., allows lifting arm FIG. 6.H. to be lowered and locked in six different positions.

Figure 8:
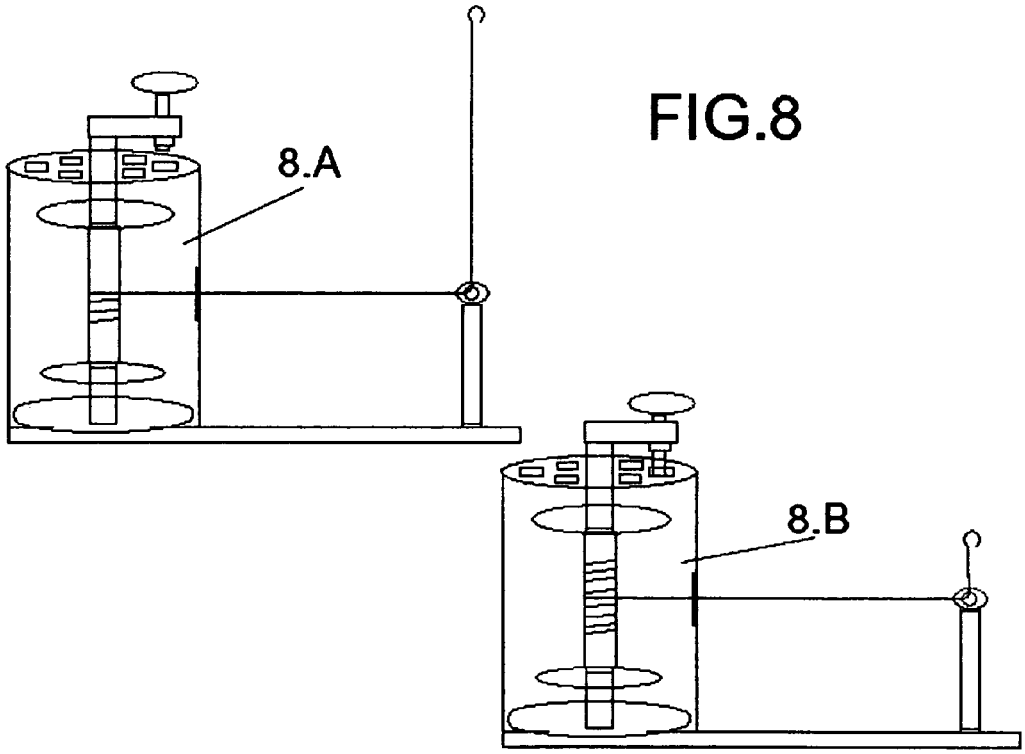

The lowering spool FIG. 7.G. shown in FIG. 8., all the way out FIG. 8.*a*., shown in FIG. 8.

The lowering spool FIG. 7.G. shown in FIG. 8., all the way in FIG. 8.B shown in FIG. 8.

FIG. 1. This invention is the floating transom, the floating transom clamps on the back of the boat making a new transom that is extended sixteen inches away from the boat transom, in doing so, the boat motor is moved back, now making it possible for the boat motor lower unit to be moved up flush with the bottom of the boat. As shown in FIG. 1. when traveling in shallow water rivers the lower unit of the boat is only inches below the water, allowing you to move up or down the river in only ten inches of water, the wake that is formed from a moving boat rises up allowing the water pump to work, keeping the boat motor cooling system working FIG. 2. The manual hydraulic lift, shown in FIG. 2. Comes as a back up system for the 12 volt hydraulic lift system. Shown in FIG. 3. The battery that runs the 12 volt hydraulic lift systems FIG. 3. losing its charge and getting to weak to work, you then change to the manual hydraulic pump FIG. 2 A. and then connect the lifting arm FIG. 6.H. to the lifting bracket FIG. 6.L in doing so the floating transom will operate normal, allowing the boat to move up and down the river FIG. 3. The floating transom has two hydraulic ram shown in FIG. 6. The lifting bracket hydraulic ram FIG. 6.B allows the boat motor to be moved up or down to adjust the motor height, allowing you to put the boat motor lower unit in the best position for the depth of water you are in, and the floating transom hydraulic ram FIG. 6.I. allowing the angle of boat motor to be adjusted in or out to make the boat move flat on the surface of the water FIG. 4. Shows the side view of the floating transom mounting bracket FIG. 4.A.

FIG. 5. Shows the top view of the mounting bracket FIG. 5.A. and the top view of the lifting bracket FIG. 5.B.

FIG. 6 Shows the list of all the parts need to make the floating transom shown in FIG. 1.

FIG. 7. Shows a list of all the parts needed for the lowering spool unit FIG. 7.

FIG. 8. Shows the lowering spool unit, turning the locking pin FIG. 7.B. in a clock wise motion, pulling in the wire cable FIG. 7.E., lowering the lifting arm FIG. 6.H. When the lifting arm FIG. 6.H. is in the best position for the boat motor, you then push down on the locking pin FIG. 6.H. locking it in place into the locking pin holes FIG. 7.H.

HYDRAULIC FLOATING TRANSOM PARTS LIST

FIG. 1 Shows the floating transom
- 1.A. The position of the boat motor when the floating transom is all the way down
- 1.B. The position of the boat motor when the floating transom is all the way up FIG. 2. Shows the manual hydraulic unit
- 2.A. Hydraulic hand pump
- 2.B. Hydraulic hose FIG. 3. Shows the 12 volt hydraulic unit
- 3.A. Lifting bracket hydraulic ram
- 3.B. Floating transom back plate hydraulic ram
- 3.C. Floating transom hydraulic unit
- 3.D. Lifting bracket hydraulic unit
- 3.E. Floating transom hydraulic, up and down switch
- 3.F. Lifting bracket hydraulic, in and out switch FIG. 4. Shows the mounting bracket
- 4.A. Floating transom mounting bracket FIG. 5. Shows the top view of the mounting bracket and lifting bracket
- 5.A. Top view of mounting bracket
- 5.B. Top view of lifting bracket FIG. 6. Shows a list of parts for the floating transom
- 6.A. Hydraulic ram mounting bolts
- 6.B. Lifting bracket hydraulic ram
- 6.C. Lifting bracket pivot rod
- 6.D. Floating transom back plate pivot rod
- 6.E. Hydraulic ram mounting bolt brackets
- 6.F. Floating transom mounting bracket
- 6.G Floating transom mounting bracket mounting clamps
- 6.H. Lifting arm
- 6.1. Floating transom hydraulic ram
- 6.J. Floating transom back plate
- 6.K. Floating transom back plate pivot rod chamber
- 6.L. Lifting bracket
- 6.M. Lifting bracket pivot rod holes
- 6.N. Floating transom back plate pivot rod holes
- 6.O. Floating transom ram mounting brackets
- 6.P. Floating transom ram mounting brackets bolts FIG. 7. Shows a list of parts for the lowering spool unit
- 7.A. Lowering spool cover
- 7.B. Locking pin
- 7.C. Wire cable line up bracket
- 7.D. Lifting arm lowering spool bottom plate
- 7.E. Wire cable
- 7.F. Wire cable hook
- 7.G. Lowering spool
- 7.H. Locking pin holes FIG. 8. Shows the lowering spool unit.
- 8.A. Lowering spool all the way out
- 8.B. Lowering spool all the way in

The invention claimed is:

1. A Floating Transom adapted to be mounted on a transom of a boat comprising, a back plate positioned approximately eighteen inches aft of said boat transom for supporting an outboard motor having a propeller, a transom mounting bracket attached to said boat transom by two mounting bracket clamps, a lifting bracket pivotally attached to an upper portion of said transom mounting bracket and pivotally attached to an upper portion of said back plate thereby allowing a height of said back plate and said outboard motor to be adjusted vertically up and down relative to a water surface, a hydraulic ram pivotally attached to a lower portion of said transom mounting bracket and pivotally attached to a lower portion of said back plate for adjusting a bottom of said back plate fore and aft relative to said transom, said transom mounting bracket, back plate, lifting bracket and hydraulic ram forming a four-bar linkage arrangement, said fore and aft adjustment of the bottom of the back plate allowing the thrust axis of the propeller to be adjusted when said back plate is adjusted vertically up and down to thereby maintain the boat flat on said water surface to allow maneuvering in very shallow water.

2. A Floating Transom In accordance with claim 1, further comprising a lifting arm attached to said lifting bracket, a lifting spool unit attached to said boat, the lifting spool unit having a lifting spool provided with a wire cable, an end of said wire cable being attached to said lifting arm such that when said wire cable is wound up on said lifting spool, said lifting arm is pulled in a downward direction which causes an upward lifting movement of said back plate and said outboard motor.

3. A Floating Transom In accordance with claim 1, further comprising a second hydraulic ram, said second hydraulic ram pivotally connected to said transom mounting bracket and said lifting bracket for causing pivotal movement of said lifting arm relative to the transom mounting bracket.

* * * * *